US006539983B2

(12) United States Patent
Khokar

(10) Patent No.: US 6,539,983 B2
(45) Date of Patent: Apr. 1, 2003

(54) WOVEN MATERIAL COMPRISING TAPE-LIKE WARP AND WEFT

(75) Inventor: Nandan Khokar, Gothenburg (SE)

(73) Assignee: Tape Weaving Sweden AB, Bromma (SE)

( * ) Notice: Subject to any disclaimer, the term of this patent is extended or adjusted under 35 U.S.C. 154(b) by 0 days.

(21) Appl. No.: 09/994,874

(22) Filed: Nov. 28, 2001

(65) Prior Publication Data

US 2002/0124900 A1 Sep. 12, 2002

Related U.S. Application Data

(62) Division of application No. 09/402,881, filed as application No. PCT/SE98/00669 on Apr. 14, 1998.

(30) Foreign Application Priority Data

Apr. 14, 1997 (SE) ..... 9701374

(51) Int. Cl.[7] ..... B29D 22/00

(52) U.S. Cl. ..... 139/383 A; 442/186; 442/199; 442/248; 139/420 A

(58) Field of Search ..... 442/186, 199, 442/248; 139/383 A, 420 A

(56) References Cited

U.S. PATENT DOCUMENTS

| | | | | |
|---|---|---|---|---|
| 4,156,957 A | | 6/1979 | McKay | |
| 4,290,458 A | | 9/1981 | Steiner | |
| 4,336,296 A | | 6/1982 | Fukuta et al. | |
| 4,388,951 A | | 6/1983 | Atkinson et al. | |
| 5,395,665 A | * | 3/1995 | Planeta | 139/389 |
| 5,431,194 A | | 7/1995 | Steiner et al. | |
| 5,455,107 A | | 10/1995 | Homma et al. | |
| 5,538,781 A | | 7/1996 | Rao et al. | |
| 5,763,069 A | * | 6/1998 | Jordan | 428/323 |
| 5,884,674 A | | 3/1999 | Steiner | |
| 5,904,186 A | | 5/1999 | Steiner | |

* cited by examiner

*Primary Examiner*—Andy Falik
(74) *Attorney, Agent, or Firm*—Birch, Stewart, Kolasch & Birch, LLP

(57) ABSTRACT

The present invention concerns weaving. In particular, it is a woven material produced using tape-like warp and tape-like weft through the employment of a rotary type shedding device which also functions as a direct specific-weave patterning device and a pick guiding device. The material according to the invention has a constructional constitution of at least some of the warp and weft that is non-homogenous. The invention also relates to a weaving device for producing woven material with tape-like warp and weft, comprising a rotary device, which is capable of producing more than one fabric simultaneously.

19 Claims, 10 Drawing Sheets

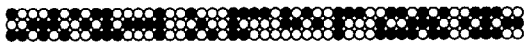
FIG.8(a)
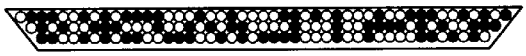
FIG.8(b)
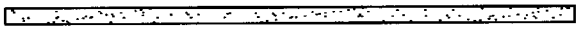
FIG.8(c)
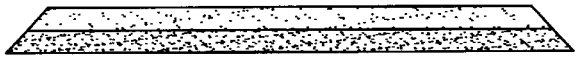
FIG.8(d)
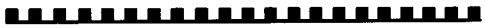
FIG.8(e)
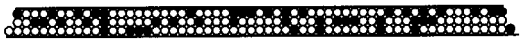
FIG.8(f)
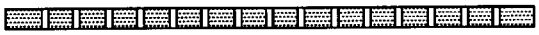
FIG.8(g)
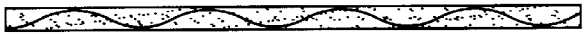
FIG.8(h)
FIG.8(i)
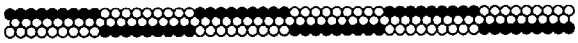
FIG.8(j)

WOVEN MATERIAL COMPRISING TAPE-LIKE WARP AND WEFT

This application is a division of application Ser. No. 09/402,881, filed Oct. 14, 1999, which is a 371 of PCT/SE98/00669, filed Apr. 14, 1998.

TECHNICAL FIELD

The present invention concerns weaving. In particular, it is a woven material produced using tape-like warp and tape-like weft through the employment of a rotary type shedding means which also functions as a direct specific-weave patterning means and a pick guiding means.

BACKGROUND

The conventional 2D-weaving process is employed for producing technical fabrics for numerous applications. For example, woven fabric structures are used in the manufacture of composite materials, geotextiles, filter fabrics, fabrics for agricultural use etc. In the production of such fabrics usually same yarns/filaments or tapes of homogenous constructional constitution (e.g. comprising similar fibres) are used. With a view to produce certain novel woven technical items, use of flat tape-like materials of non-homogeneous constructional constitution (i.e. strips/narrow films/ribbon/band etc. of non-homogeneous constructional constitution) could also be considered in many of the above said applications because such a woven item will have the advantages of relatively less crimp, higher cover factor (i.e. larger solid surface-area of the fabric due to lesser crimp), being produced quickly due to the increased width size of the input materials, etc. For example, woven non-homogeneous tape-like prepregs of parallel filaments of blended fibres e.g. carbon, glass etc. (for uniform distribution of individual fibre types in woven material and improved performance of woven material with respect to cost) embedded in a suitable matrix could be used in certain laminate type composite applications, woven tapes of sandwich/layered construction in which are combined layers of one or more type of fibre, or blend of fibres, and either one or more type of polymeric film, or one or more type of metal foil could be used as a protective material in ballistics application or as a thermal/light reflector, woven perforated tapes could be used as a filtering medium (e.g. geotextiles, in food industry), woven corrugated tapes in certain conveyor belts etc. Such different types of tapes of non-homogeneous constructional constitution do not appear to have been used earlier as warp and weft to produce novel woven materials.

However, the conventional weaving elements which directly interact with the yarns, such as heald-wires, reed and weft transporting means (shuttles, rapier heads etc.) cannot be satisfactorily employed. This is because these conventional weaving elements are designed to handle only yarns which have a circle-like cross-section and not materials which are flat such as tapes, i.e. the cross-section profile of such materials being rectangle-like. If the conventional weaving elements are employed to process flat tape-like materials, they will cause deformation of the tape-like materials leading to an unsatisfactory and an unacceptable product for the given end-application. Furthermore, the use of these elements can cause weakening of the flat tape-like materials through increased abrasion and hence render the employed materials, which are usually expensive high-performance fibrous materials, unsuitable for its intended payload.

Another important factor concerns the inability of, for example the heald wires, to handle delicately the fibrous materials which are brittle in nature such as ceramic, carbon, glass, certain synthetics etc. Elements such as the healdwires will cause severe and sharp bends to the brittle fibrous materials, as also to the other material types like metallic foil strips, during the shedding operation because of the need to lift the warp yarns sufficiently high to form a clear shed. The operation of shedding using the conventional means will therefore adversely affect the fabric production and the fabric quality by way of fibre breakages and material deformation respectively. Yet another related important drawback is that concerning the inability of the heald-wires to handle tape-like materials of relatively high thickness and stiffness compared with the usual thickness (diameter) and pliability of the yarn materials.

Further, it is necessary to lay the tape-like pick into the shed dependably and without causing abrasion to the warp material from the weft inserting means (shuttle, rapier, projectile etc.). The abrasion of the warp material by the weft inserting means is to be avoided to preserve the properties of the high-performance materials which are usually used so that the performance and the quality of the product is not diminished. In conventional shuttleless weaving practice, use is made of a suitable guide channel to prevent the abrasion of the warp yarns from the weft inserting means and to guide the insertion of the pick into the open shed. However, such a means is a separate unit from the shedding means and works independently, or in combination with the reed. Such a guiding means usually forms part of the sley assembly on which is mounted the beating-up reed. The incorporation in a weaving device of such a pick guiding means is independent of the shedding means, and is located far away from the cloth-fell position during the picking operation. Because of such separate locations of the arrangements of the shedding means and the pick guiding means, the lifting height of the shed has to be necessarily increased to obtain a clear shed for unobstructed pick insertion. As a consequence, the warp yarns are repeatedly subjected to high tensions during the shedding operation which leads to yarn breaks, which in turn, adversely affects the fabric production and quality. Clearly to prevent generation of high tensions in the warp ends, it is desirable to keep the shed height as low as possible, i.e. resonably close to the height of the employed weft inserting means such as rapier, projectile and shuttle, to enable unobstructed weft insertion.

Also, in the processing of flat tape-like materials, it is desirable to not beat-up the inserted flat tape-like weft into the position of cloth-fell using a reed with a view to eliminate the associated lateral deformation of the tape-like weft. Going by this shortcoming and also the other above-mentioned limitations, it is clear that the conventional design of weaving elements cannot be applied satisfactorily in the production of woven items comprising tape-like warp and weft. Hence, a suitable weaving alternative is necessary. The alternative efficient way would be lay the pick directly into the fabric-fell so that the conventional reciprocating beating-up operation using a reed can be avoided in the circumstances, the shedding means will have to be brought close to the cloth-fell position so that the weft can be closely laid into the cloth-fell. In bringing the shedding means close to the cloth-fell position, there is the advantage in that the cross-section size of the shed, namely the shed-height and the shed-depth, will be substantially reduced as the lifting-height of the shed will not be required to be enormous compared with the height of the employed weft inserting means. Such a reduction in the shed's cross-sectional size will reduce (i) the generation of high tensions in the warp ends, which is desirable as pointed out earlier, and (ii) the distance between the cloth-fell position and the back-rest roll position, i.e. the depth of the weaving machine. As a consequence the depth of the weaving machine will be substantially reduced making the weaving device very compact. Thus if the pick can be laid closely to the fabric-fell, there is a benefit in that the conventional reciprocating beating-up operation will become redundant, and as a consequence, the weaving process will tend to become highly simplified besides eliminating the risk of causing deformation and damage to the tape-like warp and weft materials.

Another important requirement when processing tape-like warp ends is to produce specified weave patterns such as plain weave, twill weaves, satin weaves etc. Because tape-like warp ends are greatly wider in size than yarns, they present the unique ease of being selected directly for manipulation. The yarns and filaments, because of their relatively small cross-sectional size, cannot be selected directly for manipulation as evidenced by the placement of the weave pattern selecting means such as the cams, dobby and the jacquard far away from the warp ends which in turn necessitates the use of heald wires. Therefore the ease of direct manipulation offered by the flat tape-like material creates the possibility of combining such a direct weave patterning means with the shedding means itself. Such a combining of these two different functional means would reduce the number of related components to just one in accordance with the present invention. Such a combining of two different functional means will be advantageous in that the weaving process becomes highly simplified in technical terms and profitable in economic terms due to the associated low maintenance, overhead and running costs. Also, the manufacturing time and costs of the weaving device itself stands to be reduced. As only a limited range of simple weave patterns are necessary in the production of woven technical fabrics, unlike in the production of clothing and furnishing fabrics which may require complex weave patterning means like dobby and jacquard for aesthetic reason, a specific prearranged or programmed simple weave patterning means can be combined with the shedding means without any complication as disclosed in the present invention. Such a combined means would be capable of forming the shed of the specified weave pattern only.

It is now amply clear that there is a need, and it is also desirable, to have a weaving device incorporating a single but multi-purpose component which functions as a shedding means, a specific weave patterning means, and a pick guiding means for the satisfactory processing of the flat tape-like materials of any material type capable of being woven, including brittle continuous-fibre types, to aid the production of quality woven items for certain technical applications.

Although the above described points pertain to the weaving method in which the reciprocatory shedding system is used, they are also applicable to a large extent even if the said shedding system is replaced by the existing rotary shedding systems. This is because the known rotary shedding methods have been primarily devised to handle yarns and not tape-like materials. Because the cross-sectional geometries of the yarns and tape-like materials are different, the existing rotary shedding methods are not suitable to handle tape-like warp and weft. To exemplify, a relevant shortcoming of the existing rotary shedding design is that the longitudinal open-end of the picking channel when combined with a rotary shedding system never faces in the direction of the fabric-fell. As a consequence, the pick cannot be laid directly and close to the fabric-fell and beating-up has to be necessarily carried out using either reciprocatory or rotary methods of beating-up with reed which will in turn cause severe lateral deformation and even damage to the flat tape-like weft as mentioned earlier. Also, these methods are limited in their constructional design and function and cannot be adopted to produce more than one fabric at a time even if they form multiple sequential sheds. The novelties of the present invention will become clear through the description and illustrations that follow.

BRIEF DESCRIPTION OF THE DRAWINGS

The present invention will now be described in detail with the multi-purpose means and some of the different types of tape of non-homogeneous constructional constitution as the main components of interest in the weaving of the tape-like warp and weft with reference to the accompanying drawings which are only representative of the main idea.

FIGS. 8(*a*) to 8(*j*) are cross-sectional views of some tapes of non-homogeneous constructional constitution employable in the production of novel woven materials;

DESCRIPTION OF THE PREFERRED EMBODIMENTS

Figure 1:
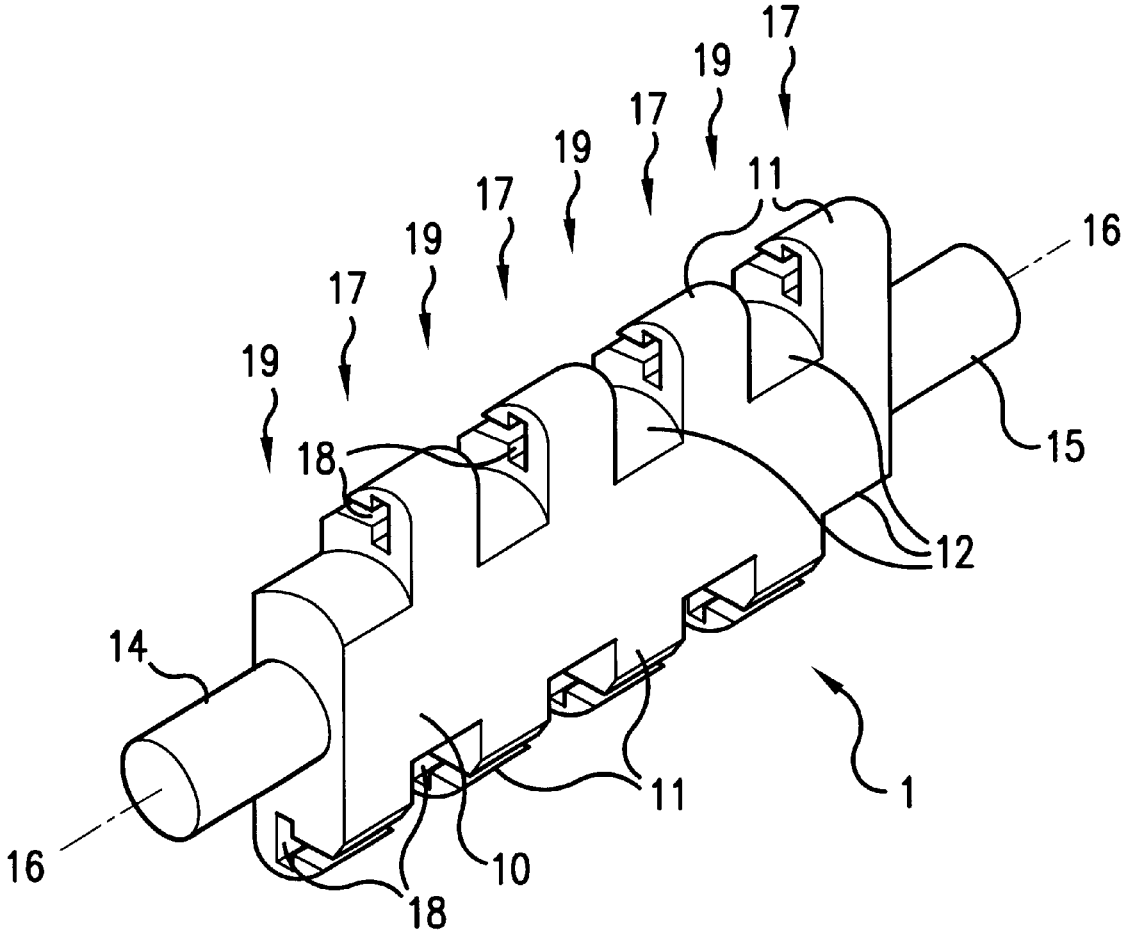
FIG. 1 is a perspective view which exemplifies the main constructional design of the rotary shedding, direct specific-weave patterning, pick guiding means.

The main constructional features of the rotary shedding, direct specific-weave patterning, pick guiding means (1) is indicated in FIG. 1 and henceforth it will be only referred to as means (1). The means (1) may be produced either directly as a single whole functioning means (1) from a bar (10), or alternatively by making it in suitable sub-parts which can be subsequently joined into a single whole functioning means (1). In its single embodiment, the said means essentially comprises a bar (10) at the two opposite sides of which are arranged in alternate order the profiled toothed regions (11) and the profiled toothless regions (12). A suitable profile channel (18) is formed into one side of each of the toothed regions (11). The collective arrangement of the profiled toothed regions (11) and the profiled toothless regions (12) together with the profiled channel (18) at each side of bar (10) may be regarded as a set of working-head of the means (1). The bar (10) when supported on its either ends (14) and (15) is rotatable about its longitudinal axis (16) through suitable linkages. The means (1) of the said description serves three different functions as follows:

(i) the locating of the specifically ordered toothed regions (11) and the toothless regions (12) in different planes on a given side of the bar (10) accords shed forming functionality to the means, (ii) the specific arrangement order of the toothed regions (11) and the toothless regions (12) on a given side of the bar (10) functions as a direct warp-end selecting means, and (iii) the channel (18) cut into each one of the toothed regions (11) function as an instant pick guiding means.

The advantage of producing the means (1) in sub-parts is that it becomes possible to alter the width dimensions of the toothed regions (11) and the toothless regions (12) suitably for accommodating corresponding different width size of tape-like warp ends over them when producing woven items incorporating tape-like warp ends of dissimilar width dimensions.

With a view to explain here the main working principle behind the present invention, reference will be made to FIGS. 1 and 2 in which the essential constructional features of the means (1) are disclosed. It should however be noted that the means (1) indicated in FIGS. 1 and 2 correspond to that suitable for producing specifically plain weave pattern. It will be apparent to those skilled in the art that other weave patterns can also be produced by applying the same strategy which will be anyway explained later with reference to FIGS. 5 and 6.

The preferable rotary type constructional design of the means (1) is indicated in FIG. 1. The toothed regions (11) and the toothless regions (12) are arranged in alternate order in the length direction and located at each of the two opposite sides of the bar (10). The length of the bar (10) corresponds at least to the width of the fabric to be produced. The location of the toothed regions (11) and the toothless regions (12) on one side of the bar (10) is offset by a pitch of one tooth relative to the location of the toothed regions (11) and the toothless regions (12) located on the opposite side of the bar (10). Thus, a toothed region (11) of a working-head on one side of the bar (10) is located opposite to a toothless region (12) of the working-head existing on the opposite side of the bar (10). When such a means (1) is rotated about its axis (16), each of the toothed regions (11) and the toothless regions (12) of a working-head located on one side of the bar (10) will come in close proximity to the marked reference points (17) and (19) respectively at one position as indicated in FIG. 1. After a further turning of the means (1) by 180 degrees, each of the toothed regions (11) and the toothless regions (12) of the working-head located on the other side of the bar (10) will come in close proximity to the reference positions (19) and (17) respectively. Thus in a given complete rotation of the means (1), the toothed regions (11) and the toothless regions (12) located on each of the two opposite working-heads of the means (1) will alternately come in close proximity to the reference points (17, 19) and (19, 17) respectively. In practice the means (1) will be rotated intermittently about its axis (16) through suitable driving linkages which are not necessary to describe here. Such an intermittent rotation of the said means (1) is necessary to provide the required dwell time for enabling pick insertion.

The specific arrangement and the width size of the toothed regions (11) and the toothless regions (12) on the bar (10) are made for selecting and accommodating a corresponding width size of tape-like warp end over each one of them in accordance with the specific-weave pattern to be produced. Also, the locating of the toothed regions (11) and the toothless regions (12) in different planes on each side of the bar (10), and in conjunction with the rotation of the means (1), enables directly the selective lifting up and not-lifting up of the adequately tensioned individual tape-like warp ends with reference to their level position to form the shed. When different widths of warp ends are to be incorporated in a fabric, the widths of the toothed and the toothless regions can be altered accordingly prior to the weaving process, for example through the use of the means constructed of sub-parts.

The toothed regions (11) and the toothless regions (12) are provided with a suitable dome-like shape so that during the turning of the said means (1) their surfaces do not bend sharply the tape-like warp ends which will come into contact with it and thereby prevent damage to the tape-like warp ends (23). Also, as indicated in the inset of FIG. 1, each of the toothed regions (11) has a 'crown' to impart stability to the warp ends located over it against lateral displacement. Such a dome-like shape with a crown could be either of the rigid type as indicated in the figure or alternatively of the rolling type through the use of, for example, a suitable cylindrical or barrel-shaped roller suitably seated in its cavity in the toothed regions (11) and the toothless regions (12).

A groove or channel (18) of suitable profile is cut at one side of each of the toothed regions (11) in a direction parallel to the axis (16) of the bar (10) as indicated in FIG. 1. All the profiled grooves (18) occur in the same level and linearly, and thus collectively form a straight pick guiding channel spanning the entire fabric-width under production. The longitudinal open side of the profiled channel (18) of a working-head face in an opposite direction relative to the open side of the channel (18) existing at the other working-head of the means (1) as shown in FIG. 1.

Having described the essential constructional features, the practical working and related aspects of the means (1) may now be described in reference to FIG. 2. At the commencement of the weaving process, the adequately tensioned warp sheet will be laid in parallel alignment with the toothed regions (11) and the toothless regions (12) such that during the turning of the means (1) the required selective warp ends (23) will be engaged by the 'rising' toothed regions (11). The 'rising' toothless regions (12), because of their particular lower location than that of the toothed regions (11) on the bar (10) will not engage with, or raise up, any of the warp ends. The non-engaged warp ends will continue to occupy the unraised level position over the toothless regions (12). As the dome-like shape of the top surface of a toothed region (11) and the toothless region (12) exist in separate parallel planes, the adequately tensioned tape-like warp ends (23) when placed over them will tend to occupy a corresponding higher and lower positions alternately. Thus, as shown in FIG. 2, when the flat tape-like warp ends (23) of suitable width will be located over the toothed regions (11) and the toothless regions (12) of the means (1), a shed will be formed. Thus, for every given rotation of the means (1), two successive sheds will be formed. The continual rotation of the means (1) will thus aid formation of successive new sheds. By inserting a tape-like weft in each of the formed sheds, an interlaced or a woven item can thus be produced as indicated.

Figure 2:
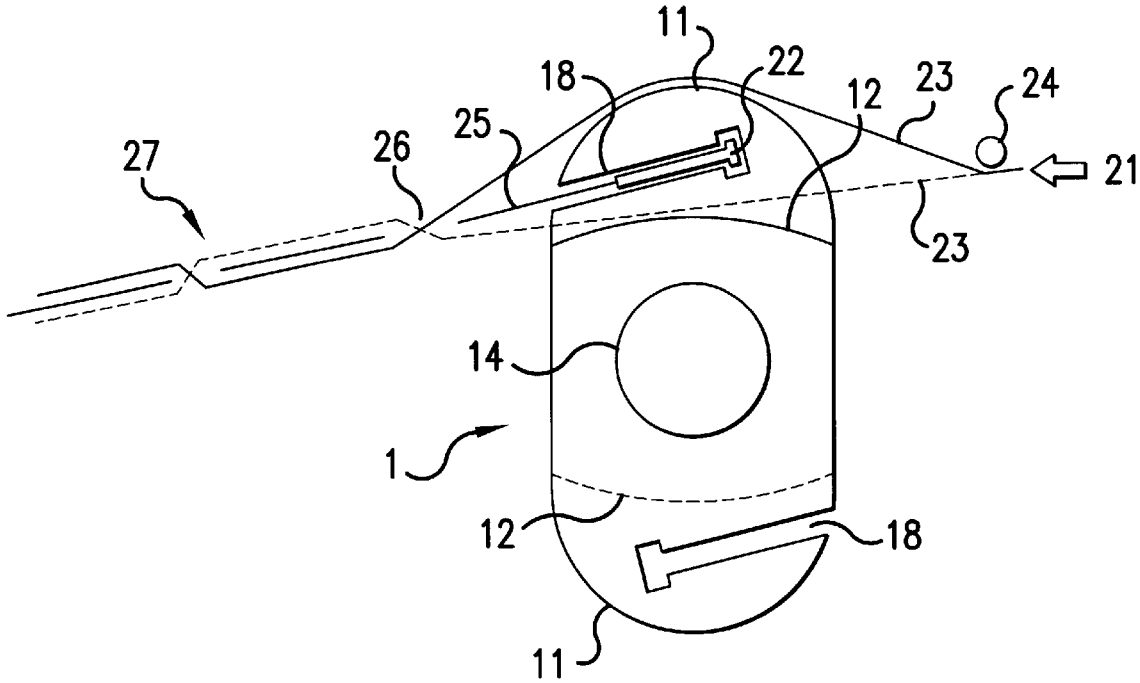
FIG. 2 is a schematic side view which exemplifies the main working principle of weaving tape-like warp and weft through the employment of the multi-purpose means.

As shown in FIG. 2, the channel (18) exists as a straight pick guiding channel within the open shed; its open-side facing the cloth-fell (26), and spanning the entire shed length (i.e. the fabric width). Thus, through this built-in pick guiding channel (18) in the toothed regions (11), a weft can be picked in the entire shed length. The existence of such a pick guiding channel (18) within the shed completely eliminates the risk of any interference that can occur between the tape-like warp (23) and the weft inserting means (22). Otherwise, there always exists the risk of displacing laterally the tape-like warp (23) located over the toothed regions (11) during the weft insertion operation. Such a lateral displacement of the tape-like warp end will cause damage to it which in turn would make the quality of the technical woven item (27) inferior. Further, the associated frequent stoppages of the weaving device for attending the fault will reduce the efficiency of the weaving device.

Also, the other important practical advantage of having the pick guiding channel (18) incorporated in toothed regions (11) is that it becomes possible to lay the pick closely at the fabric-fell (26). As a consequence, the need to beat-up the laid-in pick in the fabric-fell using a reed is avoided. Consequently, the damage to the tape-like weft which can result from the use of the reed is also eliminated.

Further, the incorporation of the pick guiding channel (18) in the shedding elements (11) offers the following associated advantages:

(i) reduced shed height, i.e. the warp ends have to be lifted up a very short distance, which leads to the generation of correspondingly low tensions in the warp ends, (ii) reduced shed-depth, i.e. the distance between the fabric-fell and the backrest roll is greatly shortened, which renders possible to make the weaving device very compact, and (iii) with the elimination of the need to use the reed, the entire reciprocating sley assembly becomes redundant which in turn contributes to make the weaving device relatively simpler, compact and inexpensive.

The insertion of the weft can be carried out either directly or indirectly. When a stiff tape-like material is to be used as a weft, for example carbon-glass continuous-fibres embedded in a matrix, it can be directly driven (pushed) from outside of the shed into the channel (18) and laid into the shed close to the fabric-fell. Alternatively, when flimsy tape-like material is to be used as a weft, e.g. metal foil, a suitable means (22) such as a rapier can be employed. Such a pick inserting means can be inserted in the pick guiding channel (18) to lay the flimsy tape-like weft (25) in the entire shed length. Such a solid weft carrier (22) will be withdrawn out of the pick guiding channel (18) subsequent to the weft insertion operation to facilitate unobstructed formation of the following new shed.

It is important to point out here that the means (1) always turns about its axis (16) in a direction such that the open side of the pick guiding channel (18) turns away from the last laid-in pick. In accordance with the view of the means (1) shown in FIG. 2, the means (1) would be required to be rotated in the clockwise direction so that the laid-in weft (25) will not come in the path of and interfere with the pick guiding channel (18) of the rotating means (1).

It may also be pointed out here that to align the laid-in pick at the fabric-fell when processing stiff tape-like weft, the means (1) may at first be turned anticlockwise, in reference to FIG. 2, to a degree necessary, with a view to employ the guide-wall located opposite to the open side of the channel (18) to push forward the pick at the fabric-fell. After such an aligning operation, the means (1) will have to be turned in the clockwise direction for the reason mentioned above.

Figure 3:
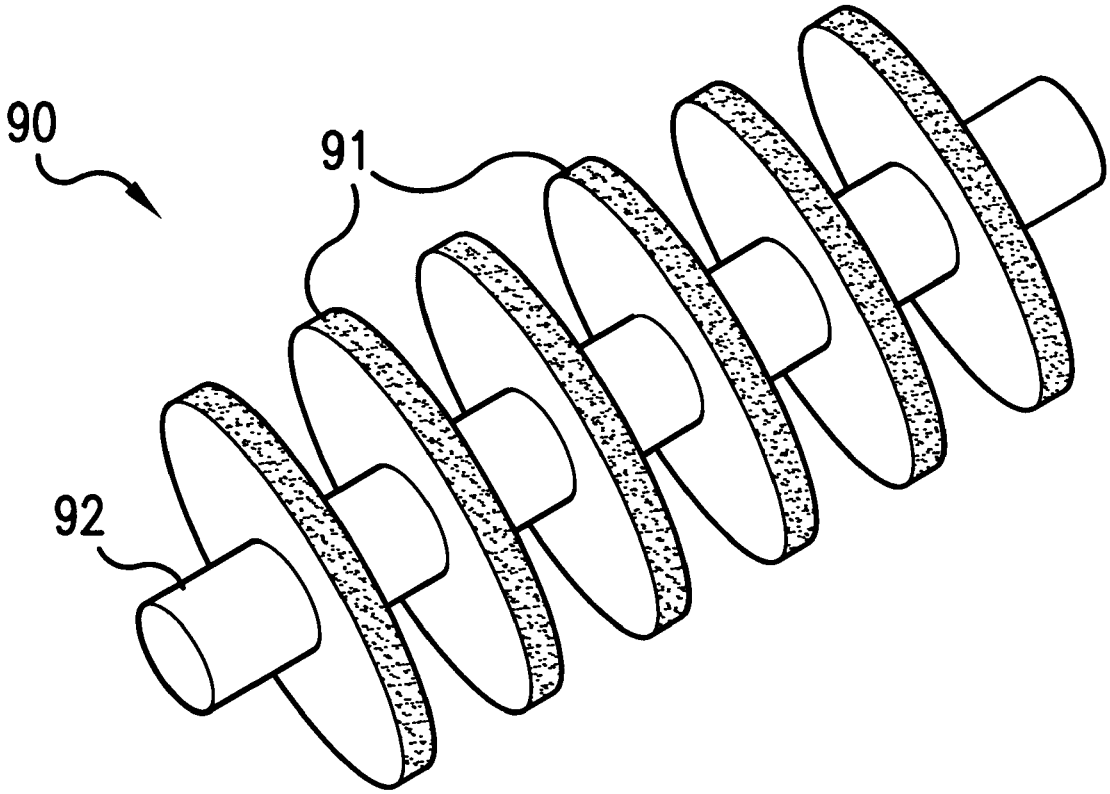
FIG. 3 is a perspective view which exemplifies the main constructional design of a suitable means employable for the purpose of aligning the laid-in tape-like pick at the fabric-fell in a weaving device incorporating the multi-purpose means.

From the foregoing it will be clear that through the employment of the means (1) the conventional reciprocative beating-up with a reed may be dispensed with. However, if aligning of the laid-in pick at the fabric-fell is required, for example when processing delicate tape-like weft, use may be made of press-rolls arrangement (90) shown in FIG. 3 which is described here only for the purpose of exemplification because many alternative pick-aligning arrangements can be employed.

The press-rolls arrangement (90) essentially comprises spaced out press-rolls (91) on a shaft (92). The thickness of each of the press-rolls (91) will correspond to the width of each of the corresponding toothed region (11) and toothless region (12). Further, the press-rolls (91) will be arranged in the same order as the arrangement order of the toothed regions (11) and the toothless regions (12) of the means (1). The assembly of the press-rollers arrangement (90) will be disposed in an orientation parallel to the axis (16) of the means (1) and located such that the axes of rotation of the means (1) and the press-rolls arrangement (90) occur on the opposite sides of the warp.

The turning of the press-rolls about its shaft (92) will be suitably matched with the turning of the means (1) and the fabric take-up system (not shown) to make the weaving process proceed uninterruptedly. Apart from the press-rolls (91) receiving the intermittent rotary motion (to correspond with the intermittent motion of the means (1)), the press-rollers arrangement (90) will also be subjected to two other successive reciprocating motions: one in the axial direction when all the warp ends (23) are level during the shed changeover, and second in the radial direction after the weft has been laid-in. These two successive reciprocating motions in the said two directions will be respectively carried out (i) to locate the press-rolls (91) in proper position or alignment with reference to the open spaces provided by the unraised warp ends and (ii) to descend the press-rolls (91) into the open spaces provided by the unraised warp ends so as to make contact with the laid-in weft in order to align it at the fabric-fell.

Subsequent to the weft aligning operation, the press-rolls arrangement (90) will be successively reciprocated in the reverse direction (i) to move out the press-rolls (91) from the open spaces provided by the unraised warp ends, and (ii) to locate the press-rolls (91) in proper position or alignment with reference to the new adjacent open spaces provided by the unraised warp ends of the subsequent new shed.

The reciprocating movement of the press-rolls arrangement (90) in the axial direction will correspond to the centre-to-centre distance between two adjacent tape-like warp ends. Through such a cycle of reciprocating motions of the press-rolls arrangement (90) the aligning of the laid-in weft with the fabric-fell can be continually accomplished to make the weaving process progress continuously.

Figure 4A:
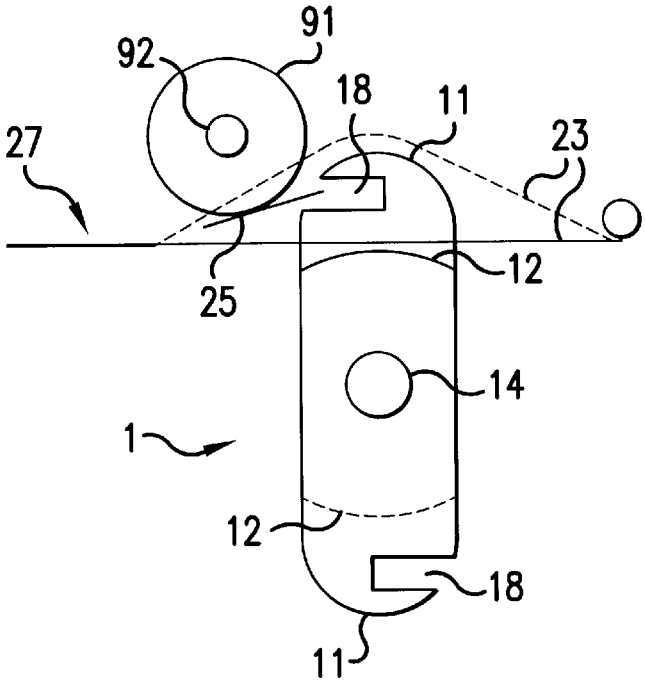
FIGS. 4(*a*) to 4(*b*) are schematic side views which exemplify the manner in which the pick-aligning means functions and its location in reference to the multi-purpose means during the aligning of the tape-like weft at the fabric-fell.
Figure 4B:
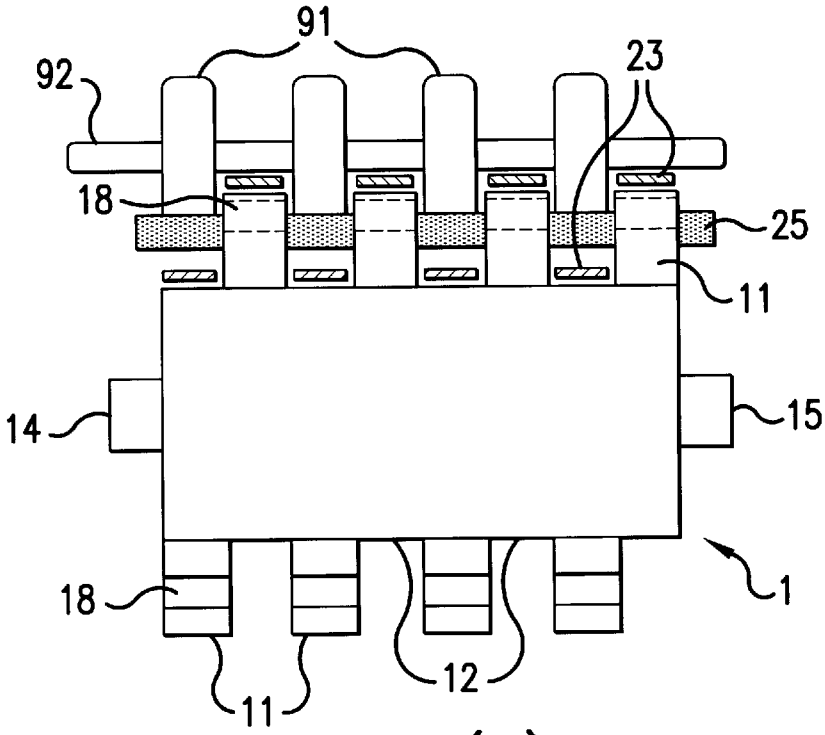

As indicated in FIG. 4, after the pick has been laid-in, the press-rolls (91) in course of its descending motion will make contact with the exposed surface areas of the laid-in pick (25) (i.e. those surface areas of the weft (25) which are not covered by the raised warp ends (23)), and through its turning motion advance the laid-in pick (25) uniformly forward for alignment at the fabric-fell (26). It is to be noted that when the press-rolls (91) will descend into the open spaces between the raised warp ends and advance the laid-in weft toward the fabric-fell (26), the unraised warp ends which exist below the weft (25) can be employed to serve as a support for the weft to make reliable contact with the press-rolls (91) for aligning at the fabric-fell.

As the tape-like weft cannot be bent smoothly at the selvedge sides of the fabric, it will be necessary to insert the weft in a length corresponding at least to the width of the fabric. As a consequence, the weft will be required to be cut at a selvedge side after every pick insertion. The formation of the selvedges can therefore be carried out employing methods like leno binding, thermal and ultrasonic welding, chemical bonding, mechanical joining (such as sewing, stitching, stapling) etc. The choice of means will depend on the material of the warp and the weft being processed and also the end application requirements. Such means can be located at each of the two sides of the fabric and activated soon after the laid-in pick has been aligned at the fabric-fell by the press-rolls (91). To produce an open fabric structure, either select or all the warp and weft cross-over points may be joined by one of the just mentioned selvedge forming methods.

Subsequent to the pick insertion and selvedge formation operations, the produced fabric can be advanced by a suitable winding type take-up arrangement (not shown). In so doing, the laid-in pick will be advanced out of the pick guiding channel (18) so that the means (1) while turning to form the successive new shed will not interfere with the last laid-in weft.

Having described the most essential features of the invention in all detail, other relevant aspects of the present invention will now be considered.

FIGS. 5 and 6 illustrate some modes of locating toothed regions (11) and toothless regions (12) on the means (1) so that it becomes possible to extend the present idea to the production of different weave patterns, such as plain weave, two-up-one-down twill weave and three-up-one-down twill weave, without deviating from the scope of the basic working principle of the means (1) described in full detail with reference to FIGS. 1 and 2.

Figure 5A:
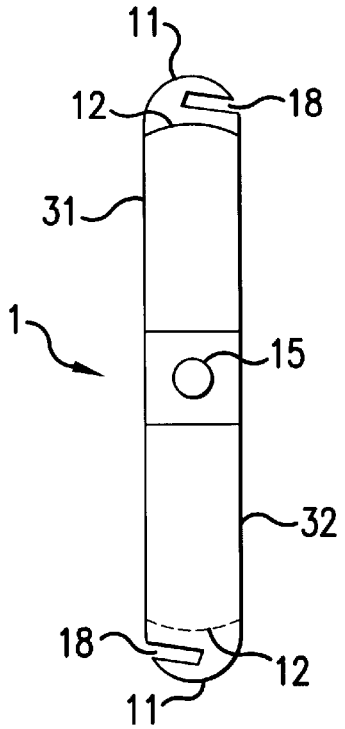
FIGS. 5(*a*) to 5(*d*) are schematic views which exemplify the different constructional types of the multi-purpose means through which plain weave and two-up-one-down twill weave patterns can be enabled.
Figure 5B:
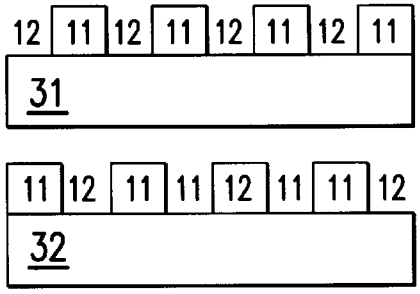

In FIG. 5*a* is shown the means (1) having toothed regions (11) and toothless regions (12) on two opposite working heads (31) and (32). FIG. 5*b* shows the arrangement order of the toothed regions (11) and the toothless regions (12) on the corresponding two working-heads (31) and (32) of the means (1). Because during the rotation of the means (1) a toothless region (12) will be followed by a toothed region (11), such a design of the means (1) will help produce a plain weave pattern.

Figure 5D:
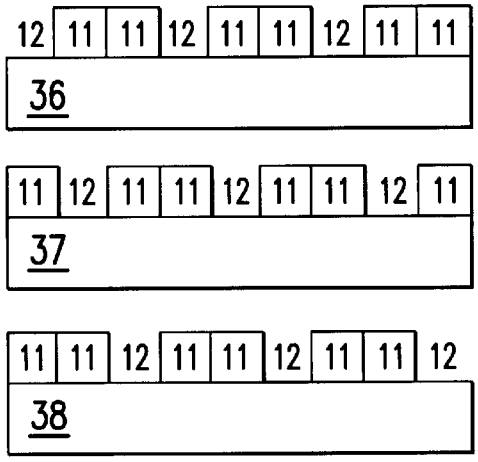
Figure 5C:
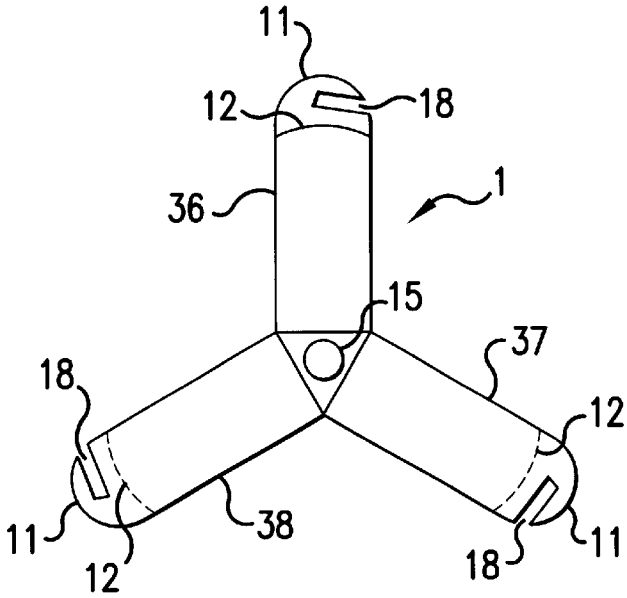

In FIG. 5*c* is shown the means (1) having toothed regions (11) and toothless regions (12) on three working-heads (36), (37) and (38). FIG. 5*d* shows the arrangement order of the toothed regions (11) and the toothless regions (12) on the corresponding three working-heads (36), (37) and (38) of the means (1). Because during the rotation of the means (1) two successive toothed regions (11) will be followed by a toothless region (12), such a design of the means (1) will help produce a two-up-one-down twill weave pattern.

Figure 6A:
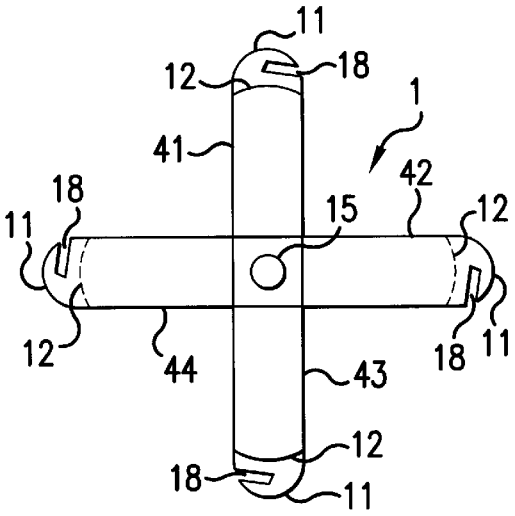
FIGS. 6(*a*) to 6(*d*) are schematic views which exemplify another constructional type of the multi-purpose means through which plain weave and three-up-one-down twill weave patterns can be enabled.
Figure 6B:
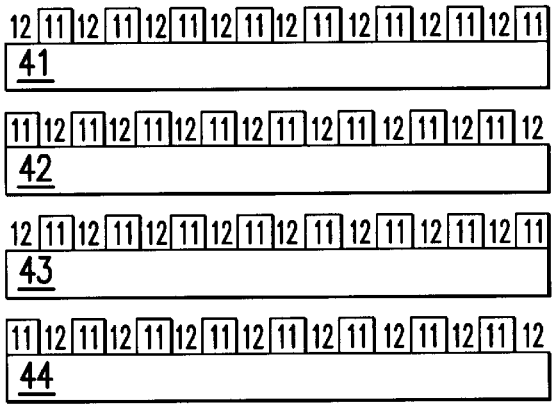

In FIG. 6*a* is shown the means (1) having toothed regions (11) and toothless regions (12) arranged on four working-heads (41), (42), (43) and (44). In principle this arrangement combines two pairs of the means (1) described in FIGS. 5*a* and 5*b*. The working-heads (41) and (42) act as one pair, and the working-heads (43) and (44) act as the other pair. FIG. 6*b* shows the arrangement order of the toothed regions (11) and the toothless regions (12) on the corresponding four working-heads of the means (1). Because during the rotation of the means (1) a toothless region (12) will be followed by a toothed region (11), such a design of the means (1) will help produce a plain weave pattern.

Figure 6C:
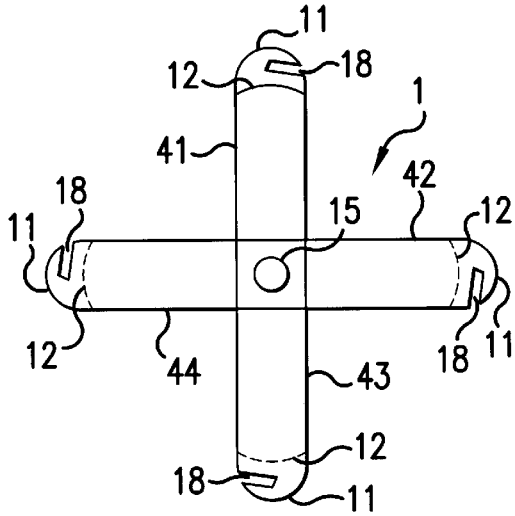
Figure 6D:
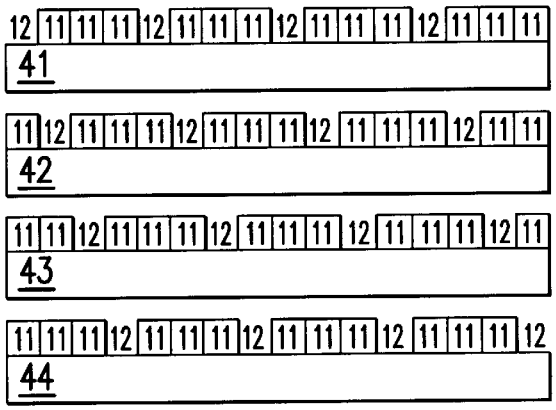

In FIG. 6*c* is shown the means (1) having toothed regions (11) and toothless regions (12) also arranged on four working-heads. However, as shown in FIG. 6*d*, the arrangement order of the toothed regions (11) and the toothless regions (12) on the corresponding four working-heads (41), (42), (43) and (44) of the means (1) differs from the one shown in FIG. 6*b*. Because during the rotation of the means (1) three successive toothed regions (11) will be followed by a toothless region (12.), such a design of the means (1) will help produce a three-up-one-down twill weave pattern.

Following the above described working design of the means (1), it is possible to produce other specific weave patterns.

As the toothed regions (11) and the toothless regions (12) of the means (1) can be specifically arranged and located on two or more working-heads of the bar (10), depending upon the constructional design of the mean (1) and weave pattern to be produced, it is possible to exploit every working-head of the means (1) in the production of corresponding number of fabrics of the same weave pattern. Because each working-head of such a means (1) can be advantageously employed to form independent sheds, it becomes possible to produce fabrics of the same weave pattern simultaneously. Hence, the number of fabrics producible simultaneously using one such type of means (1) will correspond to the number of working-heads the means (1) has. It is to be noted that every working-head of the means (1) which will be commissioned for its intended functions will have to have its own independent set of weft inserting, selvedges forming, taking-up, weft aligning and warp supplying means.

Figure 7A:
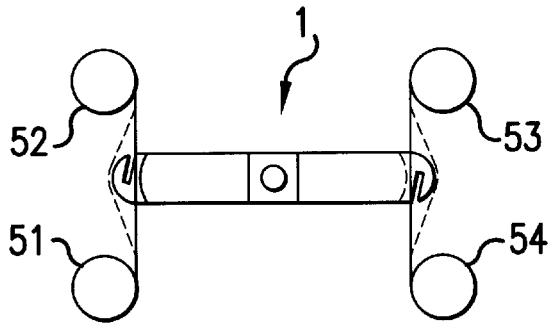
FIGS. 7(*a*) to 7(*c*) are schematic views which exemplify the modes of increasing the productivity through the employment of the multi-purpose means.
Figure 7B:
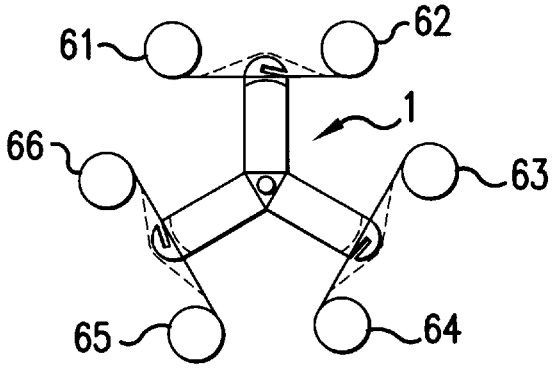
Figure 7C:
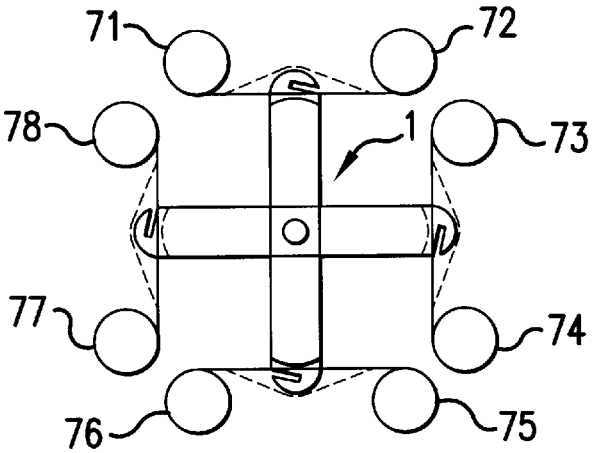

Such a manner of increasing the productivity of a weaving device is shown in FIG. 7. The arrangement for producing simultaneously two fabrics of the plain weave pattern on a weaving device incorporating means (1) is illustrated in FIG. 7*a*. In FIG. 7*b* is shown the arrangement for producing simultaneously three fabrics of the two-up-one-down twill pattern on a weaving device incorporating means (1). FIG. 7*c* shows the arrangement for producing simultaneously four fabrics of either the plain weave pattern or the three-up-one-down twill pattern on the same weaving device incorporating means (1). As shown in FIGS. 7*a*, 7*b* and 7*c*, each fabric under production has its own independent supply of the warp. Thus, in FIG. 7*a* the warp is supplied independently for the two fabrics (52) and (54) by the warp beams (51) and (53). In FIG. 7*b* the warp is supplied independently for the three fabrics (62), (64) and (66) by the warp beams (61), (63) and (65), and in FIG. 7*c* the warp is supplied independently for the four fabrics (72), (74), (76) and (78) by the warp beams (71), (73), (75) and (77) respectively. The arrangements shown in FIG. 7 are only representative of the practicable idea. In real practice the warp layer and the fabric layer at each side of the means (1) can be appropriately guided about suitably arranged guide rolls so that the necessary process path can always be easily accessed for attention.

FIGS. 8*a*–8*j* exemplify cross-sectional views of some tapes of non-homogeneous constructional constitution which are employable in the production of novel woven materials according to the present invention. FIG. 8*a* shows a tape constituting a random blend of two different fibre types; FIG. 8*b* shows a tape constituting randomly blended fibres embedded in a matrix and having a non-rectangular cross-section; FIG. 8*c* shows a layered or sandwich type tape constituting a layer of polymeric film and a layer of fibres of one type; FIG. 8*d* shows a layered or sandwich type tape constituting three layers of polymeric films and two layers of different fibre types and having a non-rectangular cross-section; FIG. 8*e* shows an embossed tape; FIG. 8*f* shows a layered or sandwich type tape constituting a layer of metal foil, a layer of randomly blended fibres and a layer of polymeric film; FIG. 8*g* shows a perforated tape; FIG. 8*h* shows a layered or sandwich type tape constituting a layer of a corrugated tape sandwiched between fibres of one type; FIG. 8*i* shows a layered construction of a metal foil and a polymeric film, FIG. 8*j* shows a layered or sandwich type tape constituting an ordered blend of two different fibre types.

Figure 9A:
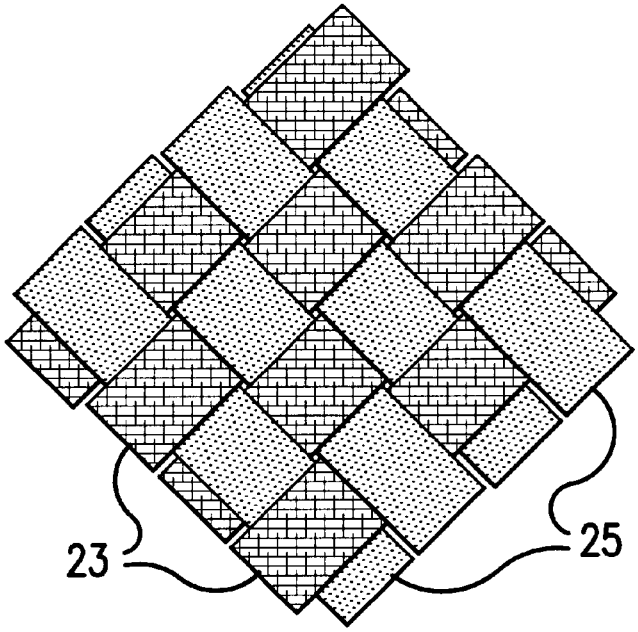
FIGS. 9(*a*) and 9(*b*) are schematic views which exemplify the woven technical fabrics comprising similar width size flat tape-like warp and weft materials of the plain weave and the three-up-one-down twill weave patterns producible through the employment of the multi-purpose means.
Figure 9B:
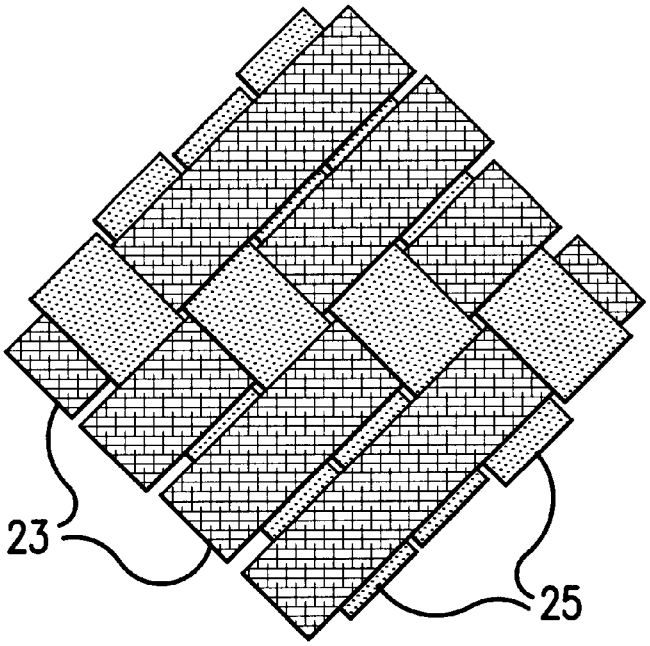

FIG. 9 exemplifies woven constructions comprising similar width size tape-like warp (23) and weft (25). FIGS. 9*a* and 9*b* show the constructional design of the plain weave pattern and the three-up-one-down twill weave pattern respectively which may be producible through the aid of the means (1). It may be pointed out here once again that means (1) can be well employed to produce woven items comprising dissimilar width size tape-like warp (23) and weft (25) and also different cross-sectional shapes of tape-like warp (23) and weft (25).

Figure 10:
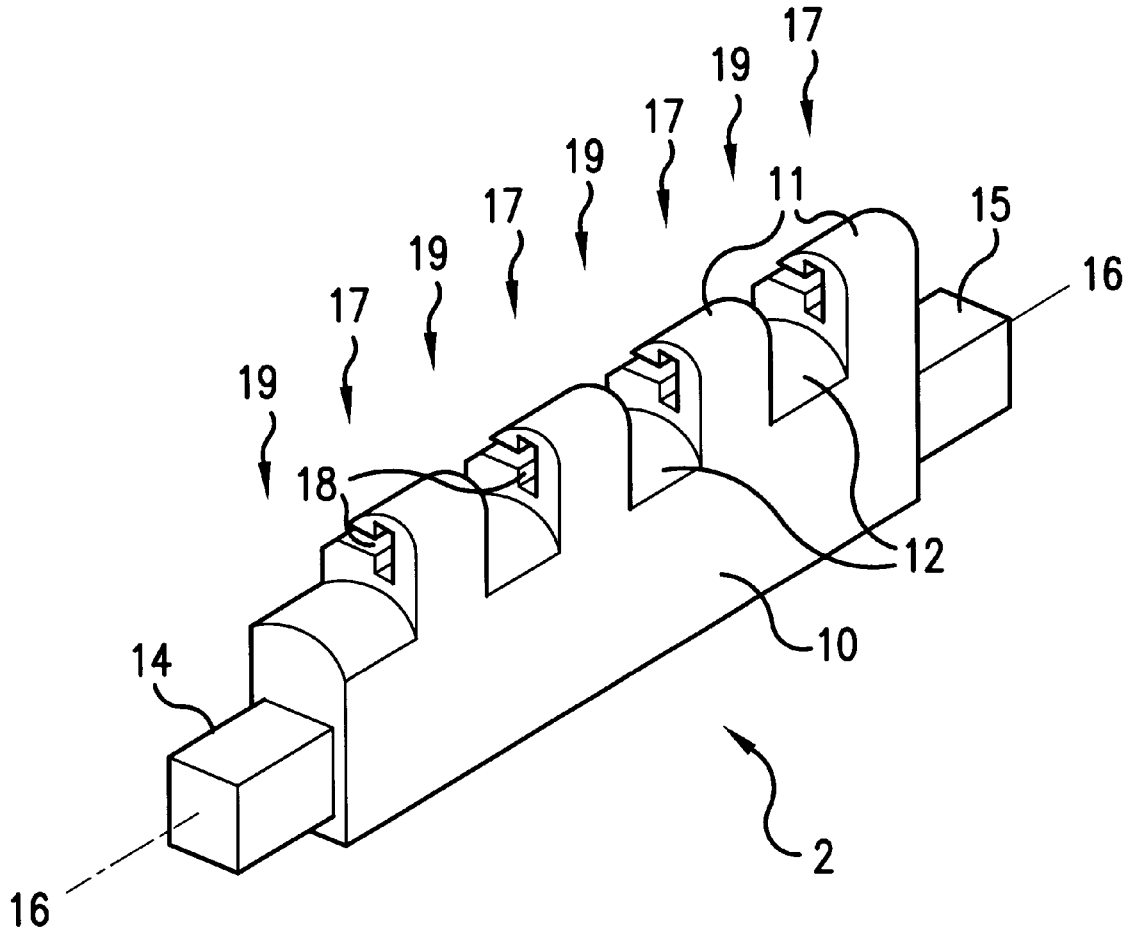
FIG. 10 is a perspective view which exemplifies an alternative form of the non-rotary type multi-purpose means.

FIG. 10 exemplifies an alternative, but less preferable non-rotary design of the means (2) to indicate a possible variation that could be considered for employment by those skilled in the art. As shown in FIG. 10, the fundamental constructional design of the means (2) remains the same as that of the means (1) indicated in FIG. 1. The shown means (2) can be employed for forming a shed, not by imparting rotary motion to it as described for the preferred design of the means (1), but by subjecting it alternately to two reciprocating motions: one in the axial direction so that the toothed regions (11) and the toothless regions (12) of the working-head can be alternately located below the tape-like warp ends, i.e. the reference positions (17, 19) and (19, 17) respectively, for selecting those warp ends which are to be raised up, and the second motion in the vertical direction such that the dome like shape of each of the toothed regions (11) makes contact with the selected warp ends and lifts them up from below to form the shed. The Dick guiding channel (18) can be made use of as described earlier. Apparently because this design requires the means (2) to be reciprocated in two mutually perpendicular directions every time, it will function in discontinuous steps rendering the weaving process relatively slower and inefficient. Moreover, such a non-rotary design of the means (2) will be disadvantageous compared with the preferred rotary design of the means (1) in that it cannot be employed to produce more than one fabric at a time according to the schemes shown in FIG. 7.

Advantages

From the presented description the following usefulness of the means (1) will be apparent to those skilled in the art.

1) It uniquely serves three functions as a single component, namely as a rotary shedding means, a direct specific-weave patterning means, and also as a pick guiding channel. As a consequence, the weaving process is rendered uncomplicated, efficient and relatively inexpensive.
2) It enables production of woven technical textile items comprising flat tape-like warp and weft which in turn has the following advantages:
   (a) It has fewer interlacing points and therefore lesser crimp compared with conventional woven fabrics comprising yarns. By reducing the amount of crimp in a woven fabric, i.e. having lesser waviness of the warp and the weft, the woven fabric can be rendered suitable for relatively higher payloads. This is because with the increased linearity or straightness of the warp and the weft in the fabric, the mechanical properties of the constituent high-performance materials can be utilised more effectively.
   (b) It has higher cover factor because the tape-like warp and weft have greater surface area due to higher width dimension compared with the dimension (diameter) of the yarns. Also, the tape-like warp and weft exist more closely in the fabric because of the reduced incidence of crimp.
   (c) It can be manufactured at a higher production rate because the width dimension of the tape-like material can be many times greater than the diameter of the yarns.
3) It enables safe processing of all types of tape-like materials such as metallic foil strips, polymeric films, layered or sandwich tapes, fabric strips/ribbons, perforated tapes, tape-like prepregs constituting continuous-fibres of brittle and non-brittle types embedded in a suitable matrix, embossed tapes, etc.
4) It enables laying of the flat tape-like pick (weft) nearly directly at the fabric-fell position eliminating the risk of deformation and damage through the undesirable operation of beating-up with a reed.
5) It eliminates the mechanical complexity, and thus reduces the number of components associated with the conventional weave pattern selecting means and the reciprocating shedding and beating-up means.
6) It eliminates the vibration, noise and the wear and tear of the components caused by the conventional reciprocating operations of shedding and beating-up.
7) It enables to bring both the shedding means and the pick guiding means close to the fabric-fell and thus reduce the depth of the shed and hence the depth of the weaving machine. As a consequence, the weaving device is rendered compact and space-saving besides relatively simple in operation and less expensive to buy and maintain.
8) It eliminates the pre-weaving operation of drawing-in the warp ends through the heald eyes and the reed dents.
9) Depending upon its constructional design, at least two fabrics may be produced at the same time and hence the productivity of the weaving device can be increased.

It will be also apparent that the use of tapes of non-homogeneous constructional constitution having blended fibres in a tape will improve distribution of individual fibre types in the woven material besides improving the performance of the woven material with respect to the cost. Through the use of non-homogeneous tapes of layered construction tapes comprising different materials, new properties can be engineered in woven materials for creating new applications. In some cases, a layered tape construction can be also beneficial in imparting processing safety to delicate and brittle materials e.g. by protecting such materials between two, layers of hard-wearing polymeric films. Similarly, with the use of perforated, embossed etc. tapes of non-homogeneous constructional constitution new woven products can be created for technical applications and through corrugated tape of non-homogeneous constructional constitution, stiffness can be realised.

It will be now apparent to those skilled in the art that it is possible to alter or modify the various details of this invention without departing from the spirit of the invention. Therefore, the foregoing description is for the purpose of illustrating the basic idea and it does not limit the listed claims.

What is claimed is:

1. A woven material comprising tape-like warp and weft, where the constructional constitution of at least some of the warp and weft is non-homogeneous, wherein at least one, of the tapes of non-homogeneous constructional constitution is perforated, embossed or corrugated.

2. The woven material according to claim 1, wherein at least some of the perforated, embossed or corrugated tapes have a sandwiched/layered construction.

3. The woven material according to claim 2, wherein the tapes of sandwiched/layered construction comprises a combination of at least two different component materials arranged in different layers.

4. The woven material according to claim 3, wherein said at least two different component materials are at least two of glass, carbon, metal, polymeric material, inorganic material and organic material.

5. The woven material according to claim 3, wherein one of said at least two different component materials is a non-fibrous material and one is a fibrous material.

6. A woven material comprising tape-like warp and weft where the constructional constitution of at least some of the warp and weft is non-homogeneous, wherein at least some of the non-homogeneous tapes have a sandwiched/layered construction, wherein at least some of the sandwiched/layered tapes have either different cross-sectional dimensions or different cross-sectional shapes.

7. The woven material according to claim 6, wherein at least some of the tapes of sandwiched/layered construction comprises a combination of at least two different component materials arranged in different layers.

8. The woven material according to claim 7, wherein the at least two different component materials are at least two of glass, carbon, metal, polymeric material, inorganic material and organic material.

9. The woven material according to claim 7, wherein the two different component materials comprises at least one non-fibrous material and at least one fibrous material.

10. A woven material comprising tape-like warp and weft, where the constructional constitution of at least some of the warp and weft is non homogeneous, wherein at least some one of the non-homogeneous tapes have a sandwiched/layered construction, in which at least one layer comprises a blend of fibers and a powder.

11. The woven material according to claim 10, wherein said at least one tape of sandwiched/layered construction comprises a combination of different high-performance fibers.

12. The woven material according to claim 10, wherein the at least one tape of sandwiched/layered construction comprises a combination of different fibers, said fibers including meltable fibers.

13. The woven material according to claim 10, wherein the powder is at least one of a powder of thermoplastic or thermosetting type or metallic or carbon, or a semi-cured chemical formulation.

14. A woven material comprising tape-like warp and weft where the constructional constitution of at least some of the warp and weft is non-homogeneous, wherein at least some of the non-homogeneous tapes have a sandwiched/layered construction in which at least one layer comprises high-performance fibers.

15. The woven material according to claim 14, wherein the at least one layer comprising high-performance fibers comprises a combination of different high-performance fibers.

16. The woven material according to claim 14, wherein the at least one layer comprising high-performance fibers comprises a combination of high-performance fibers and meltable fibers.

17. The woven material according to claim 14, wherein the at least one layer comprising high-performance fibers comprises a blend of fibers and a powder.

18. The woven material according to claim 17, wherein the powder is at least one of a powder of thermoplastic or thermosetting type or metallic or carbon, or a semi-cured chemical formulation.

19. The woven material according to claim 14, wherein the high-performance fibers are selected from the group consisting of at least one of:

glass, carbon, metal, polymeric material, inorganic material and organic material.

* * * * *